US008636013B2

(12) United States Patent
Vandromme

(10) Patent No.: US 8,636,013 B2
(45) Date of Patent: Jan. 28, 2014

(54) INSTRUMENT FOR APPLYING A COMPOSITION TO HAIR OR THE NAILS AND A RELATED METHOD OF MANUFACTURE

(75) Inventor: Michel Maurice Camille Vandromme, Le Plessis Brion (FR)

(73) Assignee: L'Oreal, Paris (FR)

( * ) Notice: Subject to any disclaimer, the term of this patent is extended or adjusted under 35 U.S.C. 154(b) by 664 days.

(21) Appl. No.: 12/574,515

(22) Filed: Oct. 6, 2009

(65) Prior Publication Data

US 2010/0089415 A1 Apr. 15, 2010

Related U.S. Application Data

(60) Provisional application No. 61/151,979, filed on Feb. 12, 2009.

(30) Foreign Application Priority Data

Oct. 6, 2008 (FR) ..... 08 05505

(51) Int. Cl.
*A45D 40/26* (2006.01)
*A46B 3/18* (2006.01)

(52) U.S. Cl.
USPC ..... 132/218; 15/187; 15/206

(58) Field of Classification Search
USPC ..... 132/218; 401/129, 127; 15/206, 187, 15/186, 188
See application file for complete search history.

(56) References Cited

U.S. PATENT DOCUMENTS

| | | | | |
|---|---|---|---|---|
| 4,733,425 | A * | 3/1988 | Hartel et al. | 15/206 |
| 4,927,281 | A * | 5/1990 | Gueret | 401/129 |
| 4,993,440 | A * | 2/1991 | Gueret | 132/218 |
| 6,241,411 | B1 * | 6/2001 | Brieva et al. | 401/129 |
| 6,427,700 | B1 * | 8/2002 | Leone et al. | 132/218 |
| 2004/0011375 | A1 | 1/2004 | Dumler | |
| 2008/0023020 | A1 | 1/2008 | Gueret | |
| 2008/0219748 | A1 | 9/2008 | Salciarini et al. | |
| 2010/0071715 | A1 * | 3/2010 | Bickford | 132/218 |

FOREIGN PATENT DOCUMENTS

| | | | |
|---|---|---|---|
| FR | 2 900 318 | A | 11/2007 |
| WO | 2004/060103 | A2 | 7/2004 |

* cited by examiner

*Primary Examiner* — Robyn Doan
(74) *Attorney, Agent, or Firm* — Oblon, Spivak, McClelland, Maier & Neustadt, L.L.P.

(57) ABSTRACT

An instrument for applying a composition to hair or nails includes a core made as a single piece that extends longitudinally along a mean longitudinal axis. The instrument includes a plurality of applicator projections for applying the composition to hair or nails. The applicator projections are carried by the core and are spread out helically along the core. The helical spreading of the projections is obtained by twisting the core. The projections are disposed on the core, prior to twisting the core, along at least three distinct radial directions about the mean longitudinal axis. The instrument further includes a twister element to which the core is attached such that the twisted nature of the core is imparted by the twister element.

17 Claims, 4 Drawing Sheets

INSTRUMENT FOR APPLYING A COMPOSITION TO HAIR OR THE NAILS AND A RELATED METHOD OF MANUFACTURE

The present invention relates to the general technical field of applicator devices for applying compositions, in particular cosmetics, to a region of the human body, preferably constituted by hair or the nails, and in particular elongate keratinous material, such as the eyelashes.

The present invention relates more particularly to an instrument for applying a composition to hair or the nails, the instrument comprising firstly a core that is made as a single piece and that extends longitudinally along a mean longitudinal axis, and secondly applicator projections for applying said composition to hair or the nails.

The present invention also relates to a method of manufacturing an instrument for applying a composition to hair or the nails, the method comprising a step a) of fabricating or of supplying a core that is made as a single piece and that extends longitudinally along a mean longitudinal axis, and a step b) of fabricating or of supplying applicator projections for applying said composition to hair or the nails.

The present invention finally relates to a machine for manufacturing an instrument for applying a composition to hair or the nails, the machine comprising:

- a station for fabricating or for supplying a core that is made as a single piece and that extends longitudinally along a mean longitudinal axis; and
- a station for fabricating or for supplying projections for applying said composition to hair or the nails.

Mascara applicators in the form of brushes are already known. Such brushes conventionally include a handle that can act as a cap for a container containing the mascara for application, and a stem that extends from the handle between a proximal end and a distal end. A multitude of bristles extend radially from the stem at the distal end thereof, thereby forming applicator means for applying mascara to the eyelashes. Such prior art brushes are for being used in the following way:

- the user dips the brush into a container containing mascara, thereby causing the bristles to be coated with mascara;
- the user then removes the brush from the container, wiping it in passing by means of a wiper endpiece of small section that is disposed in the neck of the container; and
- finally, the user brushes the eyelashes by means of the brush, thereby causing mascara to be transferred from the bristles towards and onto the eyelashes, while simultaneously combing said eyelashes.

Most prior art mascara brushes are obtained by an industrial method in which a series of independent fibers are disposed between the two branches of a metal U shaped pin, said fibers being disposed substantially one beside another along the length of the gap between the two branches of the pin. A twisting force is then applied to the pin, thereby twisting it. Twisting the pin causes the fibers to be held captive between the branches, and causes the fibers to be spread out helically, which fibers adopt a helically layered distribution.

An applicator head is thus obtained that is engaged on the stem extending from the handle, in continuity with said stem. The assembly obtained in this way forms the mascara brush.

Such prior art brushes generally give satisfaction since they are inexpensive (the industrial tooling for manufacturing them is now conventional and very widespread), while presenting adequate effectiveness in applying makeup, resulting in particular from the helical spreading of the bristles, which, by means of the resulting multiple orientations of the bristles, enhances loading of the brush with mascara and makes it possible to comb the eyelashes effectively. Loading the brush with mascara and combing effectiveness are also enhanced by the high density of bristles on the brushes.

Nevertheless, such brushes present a certain number of drawbacks.

Firstly, their method of manufacture, although well known and widespread, remains relatively tricky to implement, since it relies on combining a multitude of independent elements, namely the plurality of fibers and the U shaped pin, which elements are moreover extremely light and of very small size, and thus difficult to manipulate. Furthermore, the design of the prior art brushes and the restrictive nature of their method of manufacture do not make it possible, using a given industrial tool, to vary in significant manner the shape and the properties of manufactured brushes, in particular from the points of view of mechanical properties and of bristle shaping. Finally, given the above mentioned industrial and design constraints, although prior art brushes certainly make it possible to obtain a makeup effect that is acceptable, it is still far from being remarkable.

In order to remedy those drawbacks, a mascara brush has been proposed that uses a plate that is cut out by laser and twisted. Such a brush provides a satisfactory response to most of the above mentioned drawbacks, but that response is not as good as it might be, in particular with regard to effectiveness and comfort in applying makeup, which in some aspects are no better than those obtained with the above mentioned conventional twisted brushes In the prior art, mascara brushes have also been proposed having an applicator head (thus including bristles) that is made entirely by an operation of injection molding a plastics material. The implementation of such an injection molding operation makes it possible to obtain brushes that are extremely comfortable in use, since the fibrous bristles of conventional twisted brushes are replaced by molded bristles that are more agreeable to the touch. The use of a molding operation also makes it possible for the method of manufacturing the brushes to be industrialized easily, while making it possible to produce a wide variety of applicator head designs, in particular with regard to shape, consistency (flexibility), length, and implantation of the bristles. Such molded mascara brushes thus solve some of the problems that are associated with conventional twisted bristle brushes, but they do not however have the advantages that are associated with conventional brushes, advantages that are essentially associated with the helical spread and with the density of the bristles as described above. Using a molding operation for manufacturing the applicator head does not make it possible to obtain a helically layered distribution of the bristles, such a distribution being impossible to unmold under acceptable industrial conditions. In addition, currently known molding techniques do not make it possible to obtain a bristle density that is comparable to the bristle density presented by twisted brushes.

Furthermore, manufacture by molding can lead to brushes that present wiping behavior that is not good, with a risk of the bristles of the brush deteriorating by plastic deformation.

In the prior art, it has also been proposed to twist a molded part while it is being unmolded, or even directly in the mold, by turning the endpiece of the part. Such a technique can however turn out to be restrictive from a technical point of view, particularly since it requires the part to be deformed at a precise moment (when unmolding or still in the mold), so as to benefit from a favorable rheological state of the part. Such "hot" deformation can moreover be tricky to achieve industrially and requires specific tooling.

Consequently, an object of the invention is to remedy the various above mentioned drawbacks and to propose a novel instrument for applying a composition to hair or the nails, in particular a mascara applicator for the eyelashes, that is inexpensive and particularly simple to construct, its construction and manufacture relying on simple and proven general technical principles, and that can be made available in a multitude of variants, while making it possible to obtain an improved makeup effect.

Another object of the invention seeks to propose a novel instrument of particularly simplified construction for applying a composition to hair or the nails.

Another object of the invention seeks to propose a novel instrument for applying a composition to hair or the nails that, while being inexpensive and of particularly simple construction, makes it possible to obtain excellent comfort in use.

Another object of the invention seeks to propose a novel method of manufacturing an instrument for applying a composition to hair or the nails, and in particular a mascara applicator for the eyelashes, that, while relying on well known and proven general technical principles, is particularly simple, rapid, and inexpensive to implement, and makes it possible to obtain an instrument that can be made available in a multitude of variants, and that is likely to produce an improved makeup effect.

Another object of the invention seeks to propose a novel method of manufacturing an instrument for applying a composition to hair or the nails that relies on the implementation of a small number of steps that are very simple and quick to perform.

Another object of the invention seeks to propose a novel method of manufacturing an instrument for applying a composition to hair or the nails.

Another object of the invention seeks to propose a novel manufacturing machine that is capable of manufacturing the instrument in accordance with the invention.

The objects assigned to the invention are achieved by means of an instrument for applying a composition to hair or the nails, the instrument comprising firstly a core that is made as a single piece and that extends longitudinally along a mean longitudinal axis, and secondly applicator projections for applying said composition to hair or the nails, said applicator projections being carried by the core and being spread out helically along said core, said helical spreading of the projections being obtained by twisting the core, said projections being disposed on the core, prior to twisting said core, along at least three distinct radial directions about said mean longitudinal axis, said instrument being characterized in that it includes twister means to which said core is attached in such a manner that the twisted nature of the core is imparted by said twister means.

The objects assigned to the invention are also achieved by means of a method of manufacturing an instrument for applying a composition to hair or the nails, the method comprising a step of fabricating or of supplying a core that is made as a single piece and that extends longitudinally along a mean longitudinal axis, a step of fabricating or of supplying applicator projections for applying said composition to hair or the nails, a step of associating applicator the projections with the core in such a manner that said applicator projections are carried by the core and are disposed on said core along at least three distinct radial directions about said mean longitudinal axis, and a step of twisting the core so as to cause the projections to be spread out helically along the core, said method being characterized in that it further comprises a step of fabricating or of supplying twister means, and a step of associating said twister means with said core in such a manner that twisting the twister means causes the core to be twisted.

The objects assigned to the invention are also achieved by means of a machine for manufacturing an instrument for applying a composition to hair or the nails, the machine comprising:

- a station for fabricating or for supplying a core that is made as a single piece and that extends longitudinally along a mean longitudinal axis;
- a station for fabricating or for supplying applicator projections for applying said composition to hair or the nails;
- a station for associating the applicator projections with the core in such a manner that said applicator projections are carried by the core and are disposed on said core along at least three distinct radial directions about said mean longitudinal axis; and
- a station for twisting the core so as to cause the projections to be spread out helically along the core; the twister station comprising:
- a sub station for fabricating or for supplying twister means;
- a sub station for associating said twister means with said core in such a manner that twisting the twister means causes the core to be twisted; and
- a sub station for twisting the twister means so as to twist the core, thereby spreading out said projections helically.

Other advantages and objects of the invention appear in greater detail on reading the following description, and in the accompanying drawings that are provided purely by way of non limiting explanation, and in which.

Figure 11:
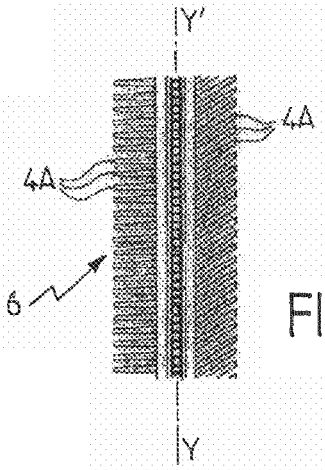
Figure 12:
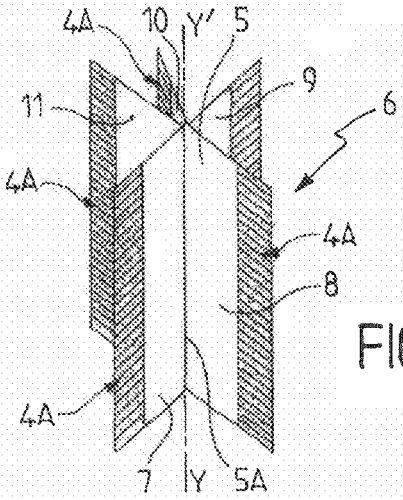

FIG. 11 is a side view showing a third embodiment of a core that is suitable for being used in the construction of an instrument in accordance with the invention, before said core is twisted; and FIG. 12 is a diagrammatic perspective view showing a fourth embodiment of a core that is suitable for being used in the construction of an instrument in accordance with the invention, before said core is twisted;

The invention relates to an instrument 1 for applying a composition, preferably liquid, semi liquid (e.g. paste), or powder, to hair or the nails, and in particular to keratinous fibers such as bristles (e.g. eyelashes, eyebrows, beard, moustache) or the hair. Advantageously, the composition for application is a cosmetic, such that the instrument 1 constitutes a cosmetic instrument in this example. In preferred manner, the composition for application is mascara for the eyelashes, the instrument 1 thus constituting a mascara applicator for the eyelashes.

In order to simplify the description, reference is made below exclusively to such a mascara applicator. However, the invention is not limited to applying a composition that presents a nature that is necessarily cosmetic, nor to applying a composition that necessarily presents a consistency that is identical to the consistency of a mascara. Thus, the instrument 1 could possibly be used for applying any composition, whatever its consistency, e.g. said composition possibly being very fluid, or conversely possibly presenting a very viscous and/or paste like consistency, or possibly even being in the form of a powder.

In manner known per se, the instrument 1 includes a handle 2 that is designed to be held and manipulated by a user, e.g. between two or three fingers. In conventional manner, the instrument 1 thus presents a portable nature and is for using manually. Preferably, the handle 2 may also be designed to act as a cap for a container (not shown) containing a stock of composition for application, which composition is preferably mascara for the eyelashes. Such an arrangement is conventional, and is therefore not described in greater detail. Preferably, the instrument 1 includes a stem 3 that extends in substantially rectilinear manner along an axial direction X X' from the handle 2, between a proximal end 3A and a distal end 3B.

In accordance with the invention, the instrument 1 includes applicator means 4 for applying the composition to hair or the nails. The applicator means 4 are preferably designed for collecting the composition for application (e.g. mascara) and for applying it to hair or the nails (e.g. the eyelashes). In the embodiment shown in the figures, the applicator means 4 are preferably and specifically designed for taking the composition for application, e.g. by being immersed in a supply thereof, and for retaining and containing the quantity of composition taken, until it is released onto hair or the nails, preferably by putting the applicator means 4 into contact with hair or the nails and by rubbing it against them. In the preferred embodiments shown in the figures in which the instrument 1 constitutes a mascara applicator for the eyelashes, and more precisely a mascara brush, the applicator means 4 further make it possible, simultaneously to coating the eyelashes with mascara, to provide a function of combing and of separating the eyelashes. To this end, the instrument 1, and more particularly its applicator means 4, includes applicator projections 4A for applying the composition to hair or the nails, which projections thus advantageously form coating and combing bristles, i.e. brush bristles that make it possible to coat the eyelashes with mascara while simultaneously combing said eyelashes. Naturally, the invention is not limited to a particular structure of applicator projections 4, said structure essentially being dictated by the consistency of the composition for application, the kind of substrate receiving the composition (e.g. the eyelashes or the nails), and the characteristics of the desired makeup effect.

In the invention, the instrument 1 includes a core 5 carrying the applicator means 4, i.e. said applicator projections 4A are carried by the core 5. This means that the core 5 acts as a substrate for the applicator projections 4A, said applicator projections thus being attached, preferably directly, to the core 5. As shown in the figures, the core 5 is a one piece core, i.e. it is made as a single piece, or in other words, it presents a unitary characteristic. This implies that the core 5 is not formed by assembling together a plurality of distinct and independent individual parts, but in itself constitutes a unitary entity. The single piece or unitary nature contributes to simplifying the manufacture and the construction of the instrument 1 in accordance with the invention, and that turns out to be invaluable for industrializing the manufacture of the instrument 1 and for the mechanical strength of said instrument.

Advantageously, the core 5 is substantially elongate, i.e. it is long and thin and in this respect it extends mostly along a single direction in three dimensions, which direction is embodied specifically by the axis Y Y' that corresponds to the mean longitudinal axis of the core 5. The core 5 thus extends longitudinally along a mean longitudinal axis Y Y' that preferably coincides with the axis X X'. Advantageously, the core 5 is made of deformable, flexible material. For example, the core 5 is made of a plastics or elastomeric material, e.g. made of polymer. Advantageously, the applicator projections 4A are made integrally with the core 5, i.e. the projections and the core comprise a single piece. In preferred manner, the core 5 and the applicator projections 4A form a one piece part 6 that is obtained by a molding operation, and preferably by an operation of injection molding a plastics and/or elastomeric material. The use of such a one piece part 6 is particularly advantageous since it greatly simplifies the manufacture of the instrument 1, while enabling a wide variety of shapes and materials for the projections 4A. The use of a molding method for manufacturing the projections 4A makes it possible in particular to make projections 4A that are particularly soft and agreeable to the touch for the user. Alternatively, the applicator projections 4A can be distinct and independent from the core 5 and can be fastened to said core by any appropriate means, e.g. by adhesive, flocking, heat sealing, crimping, or mechanical assembly, without going beyond the ambit of the invention. As shown more particularly in FIG. 2, the applicator projections 4A are spread out helically along the core 5, i.e. they are distributed in helical layers around the core 5. In other words, the applicator projections 4A are distributed like a spiral stair around the mean axis Y Y' along which the core 5 extends.

The helical spreading of the applicator projections 4A enhances the loading of the applicator means 4 with composition (mascara) and makes it possible to comb the eyelashes effectively by means of the resulting multiple orientations of the applicator projections 4A. Such helical spreading also makes it possible to create spiral "channels" between the helixes, which channels make it possible to collect and to retain the composition for application, thereby likewise enhancing the loading of the applicator means 4 with composition. In accordance with the invention, the helical spreading of the projections 4A is obtained by twisting the core 5. In other words, the core 5 is twisted, i.e. it is given a permanent spiral twist about its mean longitudinal axis Y Y'. Given that the core 5 carries the applicator projections 4A, the twisted nature of the core 5 makes it possible to spread out the projections 4A, i.e. in a distribution of the projections 4A that is locally random but that is helical (spiral) overall about the axis Y Y'.

In order to obtain applicator means 4 that are particularly effective, from the points of view both of being loaded with mascara and of the combing effect, the projections 4A are disposed on the core 5, prior to twisting said core (i.e. when said core 5 is in a not yet twisted intermediate state as shown in FIGS. 3, 4, and 6 to 12), along at least three distinct radial directions about said mean longitudinal axis Y Y', and preferably along at least four distinct radial directions D1, D2, D3, D4 about said axis Y Y'. In other words, the applicator projections 4A are implanted along at least three different angular positions about the longitudinal axis Y Y', such that they adopt a not yet twisted 3D disposition on the core 5 (shown in FIGS. 3, 4, and 6 to 12).

Thus, some of the projections 4A extend, from the non twisted core 5, along a first radial direction D1, while other projections extend from the core 5 along a second radial direction D2 that is distinct from the first radial direction D1, while still other projections 4A extend along third and fourth distinct radial directions D3, D4, respectively. In other words, the applicator projections 4A are attached to the core 5 at attachment points that are disposed on the core 5 in such a manner that the core 5 is in its non twisted state, said attachment points belonging to at least three distinct radii relative to the mean longitudinal axis Y Y'. Such a 3D distribution of the applicator means 4A on and around the core 5 makes it possible to obtain a good makeup effect that combines the advantages of conventional twisted mascara brushes and the advantages associated with molded brushes. It further turns out that the instrument 1 in accordance with the invention presents an excellent wiping behavior, such that it is possible to use a standard wiper (e.g. made of elastomer) without risk of the brush deteriorating under the effect of mechanical stress resulting from the wiping operation. Advantageously, prior to twisting said core, the projections 4A are disposed on the core 5 along at least four distinct radial directions D1, D2, D3, D4 about said mean longitudinal axis Y Y'. It has been shown by the Applicant that such a configuration makes it possible to obtain an excellent compromise between mascara loading capacity and combing effectiveness.

The specific embodiments shown in the figures are described in greater detail below.

Figure 4:
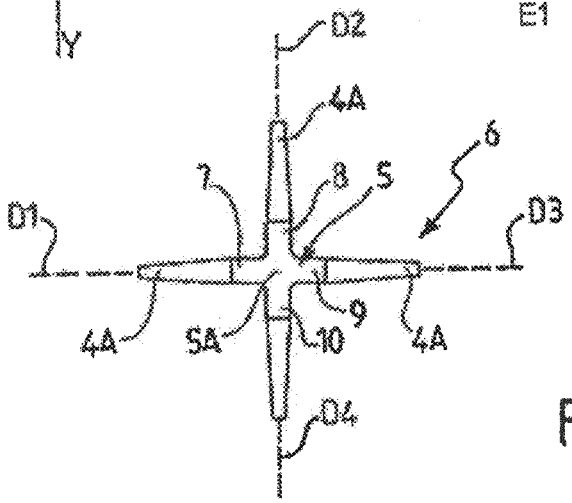
FIG. 4 is a plan view showing the core shown in FIG. 3.

In the embodiments in FIGS. 1 to 11, the core 5 is in the form of a stem of mean longitudinal axis Y Y', and having a cross section that is substantially in the shape of a cross having four branches that are disposed at 90° relative to one another (in particular see FIG. 4). However, it is entirely possible for the cross section of the core 5 to have a different shape, with a number of branches that is greater than four, as for the variant in FIG. 12, for example (five branches). It is also possible for the cross section of the core 5 to present a simple convex shape, such as a rounded or polygonal shape. In the embodiments shown in the figures, the core 5 comprises firstly a kernel 5A (visible more particularly in FIG. 4) and secondly at least three wings, and specifically four wings 7, 8, 9, 10 for the variants in FIGS. 1 to 11, or five wings 7, 8, 9, 10, 11 for the variant in FIG. 12, said wings extending radially from and along said kernel 5A, said projections 4A being carried by said wings 7, 8, 9, 10, 11. Advantageously, and as shown in the figures, the wings 7, 8, 9, 10, 11 extend over the entire length of the kernel 5A. In the embodiments in FIGS. 1 to 11, the kernel 5A includes a central axis, the core 5 including four wings 7, 8, 9, 10 that are disposed at 90° to one another about the axis Y Y', said wings 7, 8, 9, 10 preferably being of shape that is substantially rectangular, said wings 7, 8, 9, 10 extending radially from said central axis between a first edge attached to the axis and an opposite free second edge, the applicator projections 4A being attached to the free second edge, and preferably integrally formed with the free second edge. As shown in figures, the projections 4A are preferably formed by a plurality of blades that advantageously extend in the plane of each of the wings 7, 8, 9, 10, and in continuity therewith, like the teeth of a comb.

More precisely, in the embodiments under consideration, the applicator projections 4A comprise four rectilinear rows of blades that are disposed at the free end of the four wings 7, 8, 9, 10, respectively, and in the same planes as said wings.

Figure 10:
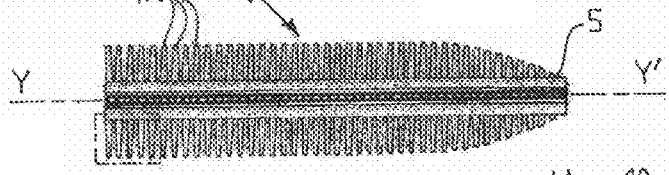
FIG. 10 is a side view showing a second embodiment of a core that is suitable for being used in the construction of an instrument in accordance with the invention, before said core is twisted.

The unitary part 6 forming both the core 5 and the applicator projections 4A is thus advantageously in the form of a shaft from which there extends, at 90° from one another, four substantially rectangular wings 7, 8, 9, 10, each of said wings being fringed at its free end, such that the fringes in question form the applicator projections 4A. In the embodiments in FIGS. 1 to 9, the blades forming the applicator projections 4A are all identical, and they extend substantially perpendicularly to the axis Y Y'. However, as shown in FIG. 10, it is entirely possible that the blades forming the applicator projections 4A are not all identical, in particular with regard to their size, so as to obtain specific brush profiles. Thus, in the embodiment in FIG. 10, the instrument 1 presents applicator means 4 of shape that is pointed at its free end so as to make it easier to apply makeup to the corner of the eye. In the embodiment in FIG. 10, the applicator means 4 thus advantageously present a bullet shaped longitudinal profile. In the embodiment in FIG. 11, the projections carried by one of the wings extend along a general direction that is not perpendicular to the longitudinal axis Y Y' of the core 5, whereas the applicator projections carried by another wing extend along a direction that is perpendicular to said axis Y Y'. Thus, the invention is absolutely not limited to any particular orientation and/or dimensioning of the projections 4A, which projections can adopt any shape desired by the person skilled in the art. It is also entirely possible, without going beyond the ambit of the invention, not to use wings at all, so that the projections 4A extend directly from the shaft forming the kernel 5A.

It is also entirely possible, in particular when manufacturing by molding, that the core 5 is made of a plurality of different materials. For example, each of the wings 7, 8, 9, 10, 11 can be made of a different polymeric material so as to benefit from different mechanical properties within a single applicator means 4.

Thus, in the embodiment in FIGS. 1 to 9, prior to twisting the core 5, the core 5 and the applicator projections 4A are in the form of a one piece part 6 of cross shaped section, the applicator projections 4A extending from the free end of each branch of the cross in question. In order to obtain the twisted core 5 and thus the spread in accordance with the invention, the instrument 1 includes twister means 12 to which the core 5 is attached in such a manner that the twisted nature of the core 5 is imparted by said twister means 12. In other words, the twisted nature of the core 5 is obtained by subjecting said core to a permanent twisting force that is exerted by the twister means 12, which are advantageously distinct from the core 5, i.e. independent from said core. Under the effect of the action of the twister means 12, the core 5 adopts its twisted shape in stable and permanent manner. In an embodiment not claimed, it is not however strictly necessary to use twister means 12 that are distinct from the core 5, and, by way of example, it is entirely possible to use appropriate materials for making the core 5, so that after exerting sufficient twisting force to impart stable plastic deformation to the core 5, said core adopts a stable and permanent twisted shape that does not need to be maintained using external means.

The use of twister means 12 that are mechanically coupled to the core 5 so as to impart a twisted nature to said core makes it possible to simplify the manufacture of the instrument 1 considerably, in particular making it possible to work "cold", with a minimum of technical constraints, with tooling of general design that relies on conventional principles and is inexpensive.

Figure 5:
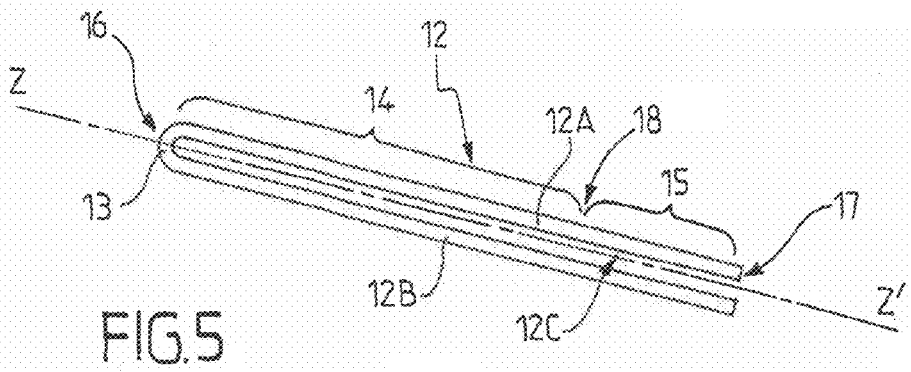
FIG. 5 is a diagrammatic perspective view showing a U shaped pin that forms the twisting means for twisting the instrument of the above listed figures, prior to said pin being twisted.
Figure 6:
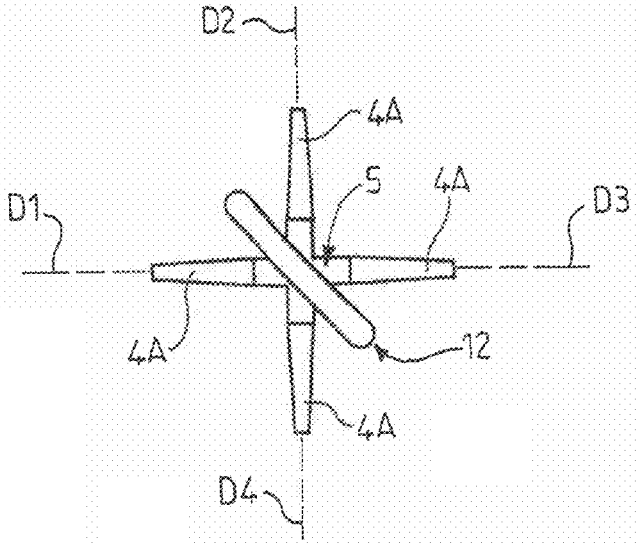
FIGS. 6 to 9 are respectively a plan view, a rear perspective view, a front perspective view, and a side view, showing the co operation between the core shown in FIGS. 3 and 4, and the twister means shown in FIG. 5, before said pin and said core are twisted.
Figure 7:
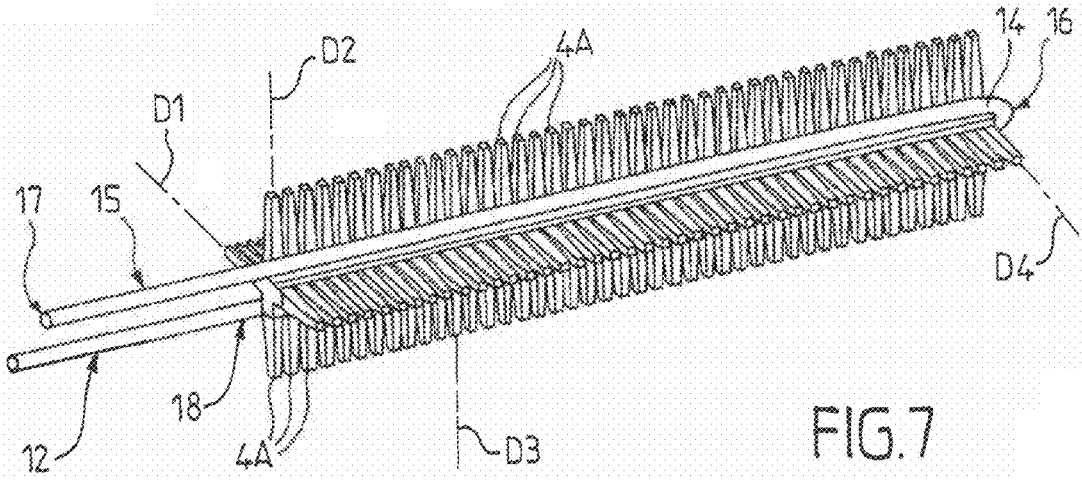
Figure 8:
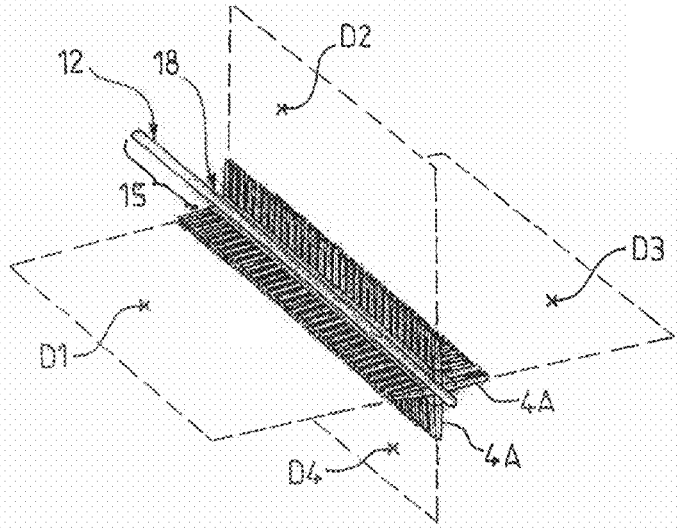
Figure 9:
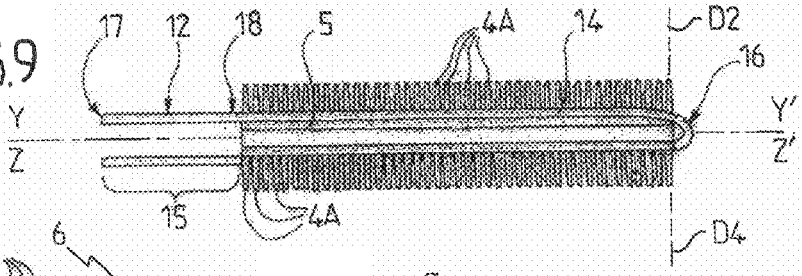

Advantageously, the twister means 12 are themselves twisted, and it is precisely the twisted nature of the twister means 12 that causes the core 5 to twist and to remain twisted, which twisting causes the applicator projections 4A to be spread helically. To this end and in preferred manner, the twister means 12 comprise at least two branches 12A, 12B that co operate with each other to define a gap 12C into which the core 5 is inserted in its non twisted state, as shown in FIGS. 6 to 9. In the embodiments shown in the figures, the branches 12A, 12B are initially substantially straight, rectilinear, and parallel to each other, as shown in FIG. 5, and the core 5 is initially not twisted when it is slid between said branches 12A, 12B. A twisting force is then exerted on the twister means 12 along their longitudinal axis Z Z' that is parallel to the branches 12A, 12B and that passes via the middle of the gap 12C. Preferably, the twisting force is exerted simultaneously on both branches 12A, 12B, thereby causing the twister means 12 to be twisted into a double helix about the axis Z Z', each helix corresponding to one of the branches 12A, 12B. The twisting of the twister means 12 simultaneously causes the core 5 to be held captive between the branches 12A, 12B, and the core 5 to be twisted about its longitudinal axis Y Y' that preferably coincides with the axis Z Z'. In this way, the core 5 and the projections 4A pass from the configuration shown in FIGS. 6 to 9 to the configuration shown in FIGS. 1 and 2.

Advantageously, the twister means 12 comprise a U shaped pin, the arms of the U shape being twisted and forming the two branches 12A, 128, said arms of the U shape being interconnected by a cross member 13 that is curved and that extends in the plane of said branches 12A, 12B. In preferred manner, the U shaped pin is made of a metal such as stainless steel, so that twisting of the pin causes permanent plastic deformation of the branches 12A, 12Ba in a spiral profile about the axis Z Z'. Such an embodiment using, as twister means 12, a pin having a plurality of branches, turns out to be particularly advantageous from an industrial point of view since it relies on a simple and proven general principle, since it is used when manufacturing conventional twisted brushes.

Figure 2:
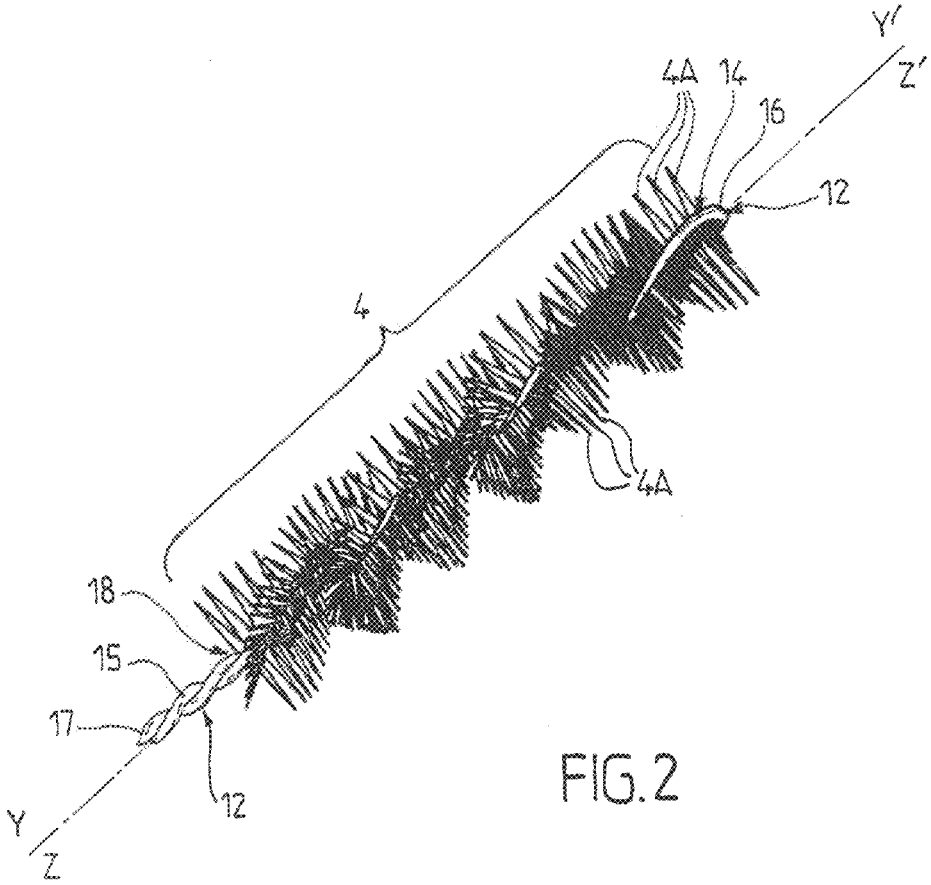
FIG. 2 is a perspective view showing an embodiment detail of the instrument shown in FIG. 1.
Figure 3:
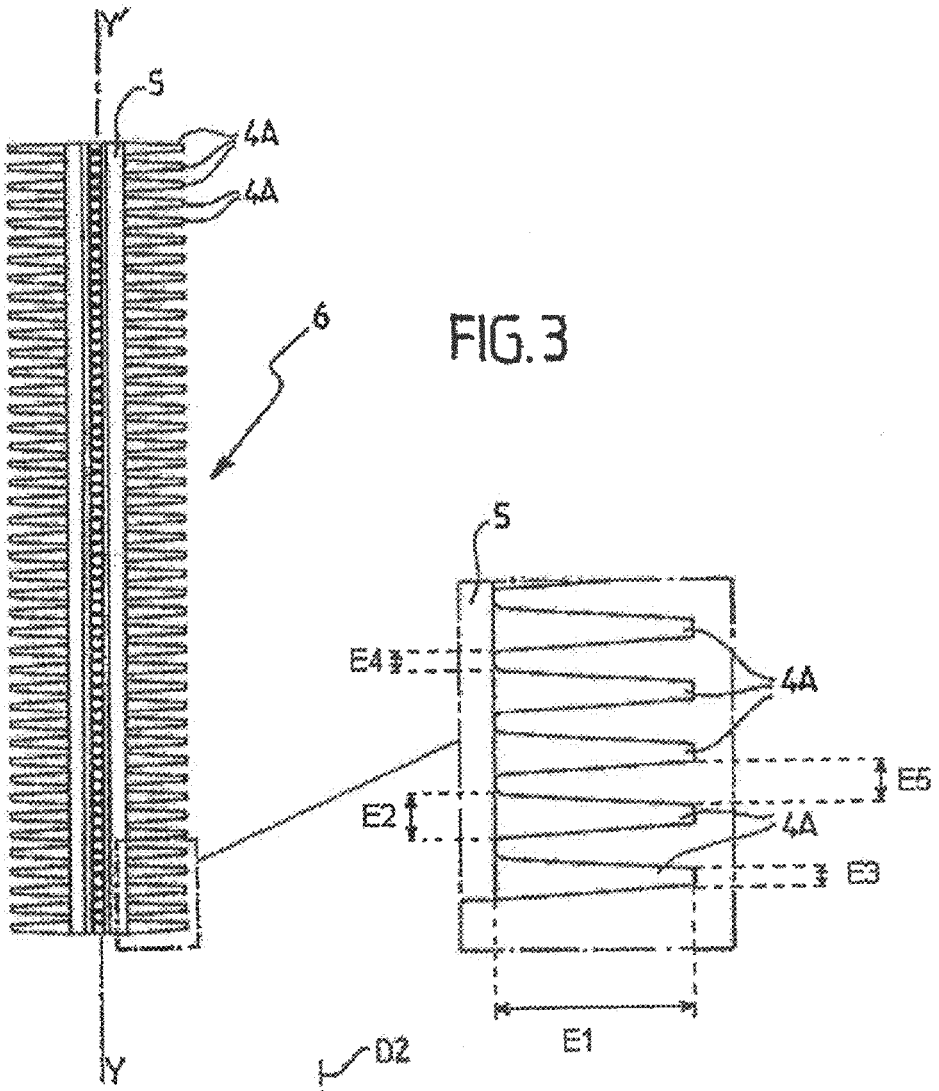
FIG. 3 is a front view showing the core prior to being twisted, and for use in the construction of the instrument shown in FIGS. 1 and 2.

Advantageously, the degree to which the twister means 12 are twisted varies over the length of said twister means, i.e. the twister means 12 present a number of turns that is not constant over its entire length. Thus, the twister means 12 preferably comprise a first portion 14 that is in contact with the core 5 and that preferably extends over the entire length (e.g. substantially equal to 30 millimeters (mm)) of said core (along the axis Y Y') from the first end 16 of the twister means 12, and a second portion 15 that is not in contact with the core 5 and that extends in the plane of the first portion 14 as far as the second end 17 of the twister means 12. As shown in FIG. 2, the degree to which the second portion 15 is twisted is advantageously greater than the degree to which the first portion 14 is twisted. For example, the first portion 14 includes five or six turns, whereas the second portion 15 includes seven or eight turns.

The use of such a twisting gradient over the length of the twister means 12 stems from the following considerations:

- The use of a core 5 for twisting in order to spread the projections 4A makes it possible, in order to obtain a satisfactory result, to use a degree of twisting that is less than the degree of twisting that is required by conventional brushes using independent rows of bristles. With regard to the first portion 14, the invention thus makes it possible to use a number of turns that is less than the number that is required for conventional twisted brushes.
- The second portion 15 is used for fastening the stem 3 to the sub assembly formed by the twisted core 5 and the twisted twister means 12. More precisely, the second portion 15 is preferably screwed, while hot, into the distal end 3B of the stem 3 that is made of a plastics material. In order to make an assembly that is sufficiently stable and robust, it is necessary for the second portion 15 to present sufficient stiffness. Sufficient stiffness is obtained by means of sufficient twisting of the second portion 15, using a degree of twisting that corresponds to the degree of twisting that is used in conventional twisted brushes of the prior art.

Advantageously, the instrument 1 in accordance with the invention is dimensioned and designed with the following parameters and properties:

- the axial length of the core 5, once twisted, advantageously lies substantially in the range 10 mm to 40 mm, preferably in the range 20 mm to 30 mm; in particularly preferred manner, the length of the core 5, once twisted, is about 28.5 mm;
- the axial length of the second portion 15 of the twister means 12, once twisted, advantageously lies substantially in the range 2 mm to 20 mm, preferably in the range 5 mm to 10 mm; in particularly preferred manner, the length of the second portion 15, once twisted, is about 8 mm;
- the second portion 15 of the twister means 12, once twisted, is advantageously inscribed in a cylindrical envelope of axis Z Z', having a radius that lies substantially in the range 0.5 mm to 2 mm, preferably substantially in the range 5 mm to 10 mm; in particularly preferred manner, the radius in question is equal to about 0.96 mm;
- once the core 5 is twisted, the projections 4A are inscribed substantially in a cylindrical envelope of axis Z Z', having a radius, corresponding to the distance between the free ends of the projections 4A and the axis Z Z', that advantageously lies substantially in the range 2 mm to 20 mm, preferably substantially in the range 5 mm to 10 mm; in particularly preferred manner, the radius in question is equal to about 7 mm;
- the height E1 of the projections 4A (consideration perpendicularly to the axis Y Y') advantageously lies substantially in the range 1 mm to 5 mm, preferably substantially in the range 2 mm to 4 mm; in particularly preferred manner, the height E1 is equal to about 2.35 mm;
- the width E2 of the projections 4A at the bases of said projections advantageously lies substantially in the range 0.2 mm to 3 mm, preferably substantially in the range 0.3 mm to 1 mm; in particularly preferred manner, the width E2 is equal to about 0.35 mm in an embodiment below called "variant A"; in another embodiment below called "variant B", the width E2 is equal to about 0.5 mm;
- the width E3 of the projections 4A at the free ends of said projections advantageously lies substantially in the range 0.1 mm to 3 mm, preferably substantially in the range 0.1 mm to 1 mm; in particularly preferred manner, the width E3 is equal to about 0.2 mm, said value being held for variant A as for variant B;
- the gap E4 between the projections 4A at the bases of said projections advantageously lies substantially in the range 0.02 mm to 3 mm, preferably substantially in the range 0.05 mm to 1 mm; in particularly preferred manner, the gap E4 is equal to about 0.1 mm in variant A, and about 0.2 mm in variant B;
- the gap E5 between the projections 4A at the free ends of said projections advantageously lies substantially in the range 0.1 mm to 3 mm, preferably substantially in the range 0.2 mm to 1 mm; in particularly preferred manner, the gap E5 is equal to about 0.25 mm in variant A, and about 0.5 mm in variant B;
- the twister means 12 are formed by a U shaped pin made from a stainless steel wire, e.g. of the AISA 316L type (molybdenum stainless steel, X2CrNiMo17 12 2), the wire in question preferably presenting a diameter that lies in the range 0.1 mm to 1 mm, more preferably substantially equal to 0.5 mm;

the core 5 is made of Hytrel® gum having a Shore hardness of 40; and the twister means twist twelve times, such that a helix can be observed presenting six turns.

The invention also relates to a method of manufacturing an instrument 1 for applying a composition to hair or the nails, and in particular an instrument 1 in accordance with the instrument described above. Preferably, the method in accordance with the invention constitutes a method of manufacturing a mascara applicator for the eyelashes. The method in accordance with the invention comprises a step a) of fabricating or of supplying a core 5 that is made as a single piece and that extends longitudinally along a mean longitudinal axis Y Y'. The method in accordance with the invention also comprises a step b) of fabricating or of supplying applicator projections 4A for applying said composition to hair or the nails. The method further comprises:

a step c) of associating the applicator projections 4A with the core 5, in such a manner that said applicator projections 4A are carried by the core 5 and are disposed on said core along at least three, and preferably four, distinct radial directions D1, D2, D3, D4 about said mean longitudinal axis (Y Y'); and a step d) of twisting the core 5 so as to cause the projections 4A to be spread out helically along the core 5.

Thus, the method in accordance with the invention rests in particular on the idea of twisting a 3D core carrying the applicator projections, so as to cause said projections to be spread out along a generally helical profile. Advantageously, as described above, steps a), b), and c) are simultaneous and coincide, i.e. the applicator projections 4A are made simultaneously and this coincides with associating said applicator projections 4A with the core 5. In other words, making the applicator projections 4A causes said projections 4A to be associated simultaneously with the core 5, and vice versa. Naturally, this simultaneity can be obtained when the applicator projections 4A are made integrally with the core 5, as described above. In this event, steps a), b), and c) advantageously coincide in a single operation for molding a part as a single piece that forms both said core 5 and said projections.

The method in accordance with the invention further comprises a step e) of fabricating or of supplying twister means 12, and a step f) of associating said twister means 12 with said core 5 in such a manner that twisting the twister means 12 causes the core 5 to be twisted, thereby spreading out the projections 4A helically along the core 5.

Advantageously, step f) is subsequent to step c), step d) comprising twisting the twister means 12 so as to twist the core 5, thereby spreading out said projections helically. Advantageously, during step e), twister means 12 are manufactured or supplied comprising two branches 12A, 12B that co operate with each other to define a gap 12C. In even more preferred manner, during step e), twister means 12 are manufactured or supplied comprising a U shaped pin, the arms of the U shape forming said two elongate branches 12A, 12B. In this event, during step f), the core 5 is inserted into said gap 12C. The U shaped pin that, in preferred manner, is made merely by folding a one piece rectilinear wire. The pin advantageously comprises two branches, it being understood that the use of a greater number of branches is not absolutely excluded in the context of the invention. Thus, it is entirely possible to provide a pin having four branches, with each of said branches being for inserting in one of four angular sectors defined by the four wings 7, 8, 9, 10 of the variant embodiment in FIGS. 1 to 9. Naturally, step f), during which the twister means 12 are attached to the core 5, seeks to provide a mechanical connection between the twister means 12 and the core 5 that is designed so that twisting deformation of the twister means 12 (twisting the U shaped pin) causes twisting deformation of the core 5 leading to said core being twisted in stable and permanent manner along its longitudinal axis Y Y'.

Advantageously, the twisting implemented in step d) is performed in such a manner that the degree to which the twister means 12 are twisted varies over the length of said twister means. In particular, said step d) preferably comprises:

twisting a first portion 14 of the twister means 12 that is in contact with the core (5), and that preferably extends over the entire length of the core 5, through a first degree of twisting; and twisting a second portion 15 of the twister means 12 that is not in contact with the core 5, through a second degree of twisting that is greater than the first degree of twisting.

For example, the first portion 14 is twisted in such a manner that it includes five or six turns, whereas the second portion 15 is twisted so that it includes seven or eight turns. The implementation of this particular twisting step, that is sub divided into two sub steps that differ in the degree to which twisting occurs, makes it possible to adapt the structure of the twister means 12 to the function that is assigned thereto. Thus, the first portion 14 of the twister means 12 should both present suitable mechanical strength (in particular stiffness) and spread out the projections 4A sufficiently, whereas the second portion 15 should have excellent mechanical behavior (in particular from a stiffness point of view) so as to provide assembly with the stem 3 that is stable, robust, and durable. Advantageously, the method in accordance with the invention includes an assembly step in which the unitary sub assembly (shown in FIG. 2) formed by the twister means 12 and the core 5 is fastened to the stem 3 by heating the second portion 15 of the twister means 12, then, while the second portion 15 is still hot, screw fastening said second portion 15 in the distal end 3B of the stem 3 that is preferably made of a plastics material. The second portion 15 is thus screw fastened by force and while hot into the distal end 3B of the stem 3, thereby ensuring, after the stem 3 has cooled, that the applicator head 4 is secured in firm and stable manner on and at the end of the stem 3.

Without going beyond the ambit of the invention, it is also possible that, in addition to the core 5, free fibers are inserted into the gap of the U shaped pin. Thus, during the step of twisting the U shaped pin that forms twister means 12, said free fibers are themselves also subjected to a helical movement causing them to spread out. In this event, a "mixed" applicator head is obtained comprising both the projections 4A coming from the core 5 and free fibers (variants not shown).

It is also possible that after the step of twisting the core 5, preferably by twisting the twister means 12, the general profile of the applicator means 4, formed by the plurality of projections 4A spreading out helically, is modified by machining, i.e. by removing material from the spiraled layers formed by the projections 4A.

Figure 1:
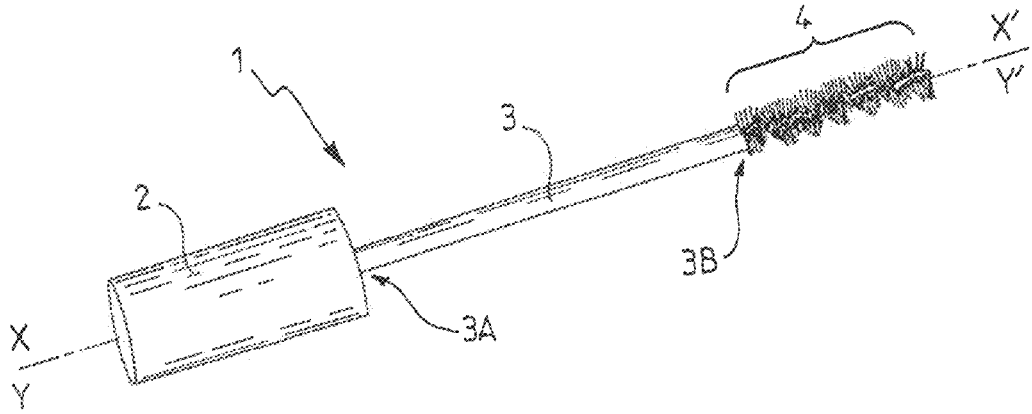
FIG. 1 is a diagrammatic perspective view showing an instrument, constituting a first embodiment variant of the invention, for applying mascara to the eyelashes.

The twisted core 5 carrying the projections 4A is finally secured by any appropriate means (e.g. crimping or adhesive) to the stem 3 towards the distal end 3B thereof, as shown in FIG. 1. The twisted core 5 carrying the projections 4A thus forms an applicator head for the instrument 1, which applicator head extends, from the distal end 3B, substantially in the extension of the stem 3, along the axis X X'.

Finally, the invention relates specifically to a machine for manufacturing an instrument 1 for applying a composition to hair or the nails, and in particular to an instrument 1 in accordance with the invention as described above, said manufacturing machine comprising:

- a station for fabricating or for supplying a core 5 that is made as a single piece and that extends longitudinally along a mean longitudinal axis Y Y';
- a station for fabricating or for supplying applicator projections 4A for applying said composition to hair or the nails;
- a station for associating the applicator projections 4A with the core 5 in such a manner that said applicator projections 4A are carried by the core 5 and are disposed on said core along at least three distinct radial directions D1, D2, D3, D4 about said mean longitudinal axis Y Y'; and
- a station for twisting the core 5 so as to cause the projections 4A to be spread out helically along the core 5.

The machine in accordance with the invention is thus likely to implement the method in accordance with the invention described above. Advantageously, the station for fabricating or for supplying the core 5, the station for fabricating or for supplying applicator projections 4A, and the station for associating the applicator projections 4A with the core 5 are combined together in a single station that consists of a molding unit that makes it possible to obtain, in a single operation, by molding a plastics or elastomer material, a one piece part 6 that forms the core 5 and the projections 4A. The twisting station itself further comprises:

- a sub station for fabricating or for supplying twister means 12;
- a sub station for associating said twister means with said core 5 in such a manner that twisting the twister means 12 causes the core 5 to be twisted; and
- a sub station for twisting the twister means 12 so as to twist the core 5, thereby spreading out said projections helically.

Advantageously, the sub station for twisting the twister means 12 itself comprises:

- a first tool for twisting a first portion 14 of the twister means 12 that is in contact with the core 5, through a first degree of twisting; and
- a second tool for twisting a second portion 15 of the twister means 12 that is not in contact with the core 5, through a second degree of twisting that is greater than the first degree of twisting.

The manufacturing machine in accordance with the invention thus makes it possible to implement the above described method, with a view to obtaining the instrument 1 in accordance with the invention also described above. Preferably, the first tool for twisting the first portion 14 of the twister means 12 comprises a pair of clamps, of which one is for gripping the first end 16 of the twister means 12, while the other is for gripping the twister means 12 at the separation interface 18 between the first portion 14 and the second portion 15 of the twister means 12. The clamps are then turned relative to each other along the axis Z Z' in such a manner as to cause the first portion 14 to twist, said twisting preferably being performed so that, after said operation, said first portion 14 includes five or six turns, as shown in FIG. 2. Advantageously, the second tool for twisting the second portion 15 of the twister means 12 comprises a pair of clamps, of which one is for gripping the second end 17 of the twister means 12, while the other is for gripping the twister means 12 at the separation interface 18 between the first portion 14 and the second portion 15, said clamps being turned relative to each other along the axis Z Z' so as to cause the second portion 15 to twist in such a manner that said second portion 15 advantageously presents a number of turns that is greater than the number of turns of the first portion 14, e.g. seven or eight turns.

Naturally, it is not absolutely excluded that the manufacturing machine in accordance with the invention can be used to manufacture instruments other than the instruments in accordance with the invention.

The invention finds its industrial application in the design, manufacture, and use of instruments of the mascara brush type for applying compositions to hair or the nails.

The invention claimed is:

1. An instrument for applying a composition to hair or nails, the instrument comprising:

- a core made as a single piece and extending longitudinally along a mean longitudinal axis;
- a plurality of applicator projections for applying said composition to hair or nails, said applicator projections being carried by the core and being spread out helically along said core, said helical spreading of the projections being obtained by twisting the core, and said projections being disposed on the core, prior to twisting said core, along at least three distinct radial directions about said mean longitudinal axis; and
- twister means attached to said core such that a twisted nature of the core is imparted by said twister means.

2. The instrument according to claim 1, wherein said applicator projections are made integrally with said core.

3. The instrument according to claim 1, wherein the core includes a kernel and at least three wings that extend radially from and along said kernel, said applicator projections being carried by said wings.

4. The instrument according to claim 3, wherein the kernel includes a central axis, and

- wherein the core includes four wings that extend radially from said central axis between a first edge attached to the axis and an opposite free second edge, said applicator projections being attached to said free second edge.

5. The instrument according to claim 1, wherein the core and the applicator projections form a one-piece part obtained by a molding operation.

6. The instrument according to claim 1, wherein said twister means is twisted.

7. The instrument according to claim 6, wherein the twister means includes at least two branches that cooperate with each other to define a gap into which said core is inserted.

8. The instrument according to claim 7, wherein the twister means includes a U-shaped pin having arms, the arms of the pin being twisted and forming said two branches.

9. The instrument according to claim 6, wherein a degree to which the twister means is twisted varies over a length of said twister means.

10. The instrument according to claim 9, wherein the twister means includes a first portion in contact with the core and a second portion not in contact with the core, and

- wherein a degree to which the second portion is twisted is greater than a degree to which the first portion is twisted.

11. The instrument according to claim 10, wherein the first portion includes five or six turns, and the second portion includes seven or eight turns.

12. The instrument according to claim 1, wherein the instrument is a mascara applicator for eyelashes.

13. The instrument according to claim 1, wherein the mean longitudinal axis extends along a length of the instrument.

14. The instrument according to claim 1, wherein each of the applicator projections extends substantially perpendicular to the mean longitudinal axis of the instrument.

15. The instrument according to claim 1, further comprising a handle connected to the twister means, the handle extending longitudinally, wherein the core extends substantially parallel to the longitudinal extension of the handle.

16. The instrument according to claim 1, wherein the core includes a kernel and at least three wings that extend radially from and along said kernel, and wherein the twister means includes a U-shaped pin having two arms, the arms of the pin extending longitudinally along opposite sides of a length of the core and between adjacent wings so as to straddle an end portion of the core.

17. The instrument according to claim 3, wherein each of the three wings extends in one of the three distinct radial directions, respectively, and wherein the plurality of the applicator projections includes intermittently spaced individual projections disposed along a length of each wing such that each wing contains more than one applicator projection.

* * * * *